US008675032B2

(12) United States Patent
Kudo et al.

(10) Patent No.: US 8,675,032 B2
(45) Date of Patent: Mar. 18, 2014

(54) IMAGE FORMING APPARATUS

(71) Applicant: Canon Kabushiki Kaisha, Tokyo (JP)

(72) Inventors: Yoshiki Kudo, Mishima (JP); Hiroshi Mano, Numazu (JP); Toshikazu Tsuchiya, Susono (JP); Yasuo Yoda, Numazu (JP); Atsushi Ogata, Mishima (JP); Naoto Tsuchihashi, Yokohama (JP); Takahiro Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/714,281

(22) Filed: Dec. 13, 2012

(65) Prior Publication Data

US 2013/0155163 A1 Jun. 20, 2013

(30) Foreign Application Priority Data

Dec. 15, 2011 (JP) ..... 2011-275018

(51) Int. Cl.
*B41J 2/39* (2006.01)
*B41J 2/40* (2006.01)
*G03G 15/05* (2006.01)

(52) U.S. Cl.
USPC ..... 347/112; 347/120

(58) Field of Classification Search
USPC ..... 347/111, 112, 120
See application file for complete search history.

(56) References Cited

U.S. PATENT DOCUMENTS 4,365,549 A * 12/1982 Fotland et al. ..... 347/127
5,852,455 A * 12/1998 Van Ham et al. ..... 347/55
7,505,880 B2 * 3/2009 Sasaki et al. ..... 703/2

FOREIGN PATENT DOCUMENTS

JP 62-81659 A 4/1987
JP 3-8544 B2 2/1991
JP 2005-345119 A 12/2005

OTHER PUBLICATIONS

R. M. Shaffert, "Electrophotography", Kyoritsu Shuppan Co., Ltd.; p. 291.

* cited by examiner

*Primary Examiner* — Huan Tran
(74) *Attorney, Agent, or Firm* — Canon U.S.A., Inc. IP Division

(57) ABSTRACT

An image forming apparatus includes: an image bearing member configured to bear a toner image; a plurality of electrode portions; a control unit configured to control a voltage applied to the electrode unit based on image information; and a toner bearing member configured to bear toner and form a toner image on the image bearing member according to the voltage applied to the electrode portion, in which $\alpha>1.22$ is satisfied and rx"/ry" is defined as $\alpha$, where Dy indicates a thickness of the image bearing member, Dx indicates a distance between the electrode portions adjacent to each other, rx" indicates a resistance component of the image bearing member in a direction parallel to Dx and ry" indicates a resistance component of the image bearing member in a direction parallel to Dy in a rectangular solid body including Dx and Dy in a side.

3 Claims, 13 Drawing Sheets

DESCRIPTION OF CALCULATION AND DIVISION

DEFINITION OF CURRENT (x, y)

RESISTANCE MEASUREMENT IN THICKNESS DIRECTION Y

RESISTANCE MEASUREMENT IN AXIAL DIRECTION X

IMAGE FORMING APPARATUS

BACKGROUND OF THE INVENTION

1. Field of the Invention

One disclosed aspect of the embodiments relates to an image forming apparatus for bearing toner on a recording material to form an image.

2. Description of the Related Art

As a conventional image forming apparatus, there is a multi-stylus printer that uses a stylus electrode (Japanese Patent Publication No 3-8544). In this multi-stylus printer, an image forming electrode including many stylus electrodes and a cylindrical counter electrode are arranged to face each other with a predetermined gap, and a recording member is conveyed to this gap to contact the image forming electrode. In this state, a voltage corresponding to an image signal is applied to the image forming electrode, and gap discharging is carried out to form a toner image.

The conventional multi-stylus printer using the stylus electrodes in the image forming electrode has a problem, i.e., a stable line width may not be acquired when forming a thin line.

FIG. 12 is a schematic model diagram illustrating a configuration of the conventional image forming apparatus using the stylus electrodes, which includes an image forming electrode 301, a counter electrode 302 bearing toner T, and a recording member 303.

This image forming apparatus uses the gap discharging to bear a toner image on the recording member 303. Specifically, by the gap discharging, charges are supplied from the image forming electrode 301 to a surface opposite a surface of a toner image bearing surface of the recording member 303, and the toner image is retained on the recording member 303 by a coulomb force of the charges. A gap is necessary for generating the gap discharging. A small gap is generated by forming a concave-convex shape on a side of the recording member 303 contacting the image forming electrode 301.

As widely known, a discharging start voltage Vb in a discharging phenomenon in a gap Z can be approximated by the following equation (1) in a gap of 10 μm or more in an atmosphere according to Paschen's law:

$$Vb=312+6.2Z \quad (1)$$

(Source: p 291 "Electrophotography" by R. M. Shaffert, Kyoritsu Shuppan Co., Ltd.)

In the gap Z, when a potential difference is larger than the discharging start voltage Vb, discharging occurs, and continues until the potential difference is reduced to the discharging start voltage Vb. A surface potential on a non-discharge surface of the recording member 303 after the discharging depends on the gap Z. This means that uneven charging occurs along the concave-convex shape of the recording member 303. In a place where charges are at a lower level in the uneven charging, a holding force of the toner T on the recording member 303 decreases, consequently causing unevenness on the toner image. This unevenness created an unstable line width of the thin line.

SUMMARY OF THE INVENTION

According to an aspect of the embodiments, an image forming apparatus includes: an image bearing member configured to bear a toner image; a plurality of electrode portions; a control unit configured to control a voltage applied to the electrode unit based on image information; and a toner bearing member configured to bear toner and form a toner image on the image bearing member according to the voltage applied to the electrode portion, in which $\alpha>1.22$ is satisfied, where Dy indicates a thickness of the image bearing member, Dx indicates a distance between the electrode portions adjacent to each other, rx" indicates a resistance component of the image bearing member in a direction parallel to Dx, and ry" indicates a resistance component of the image bearing member in a direction parallel to Dy in a rectangular solid body including Dx and Dy in a side, and rx"/ry" being defined as $\alpha$.

Further features and aspects of the embodiments will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

Various exemplary embodiments, features, and aspects of the disclosure will be described in detail below with reference to the drawings.

Figure 1:
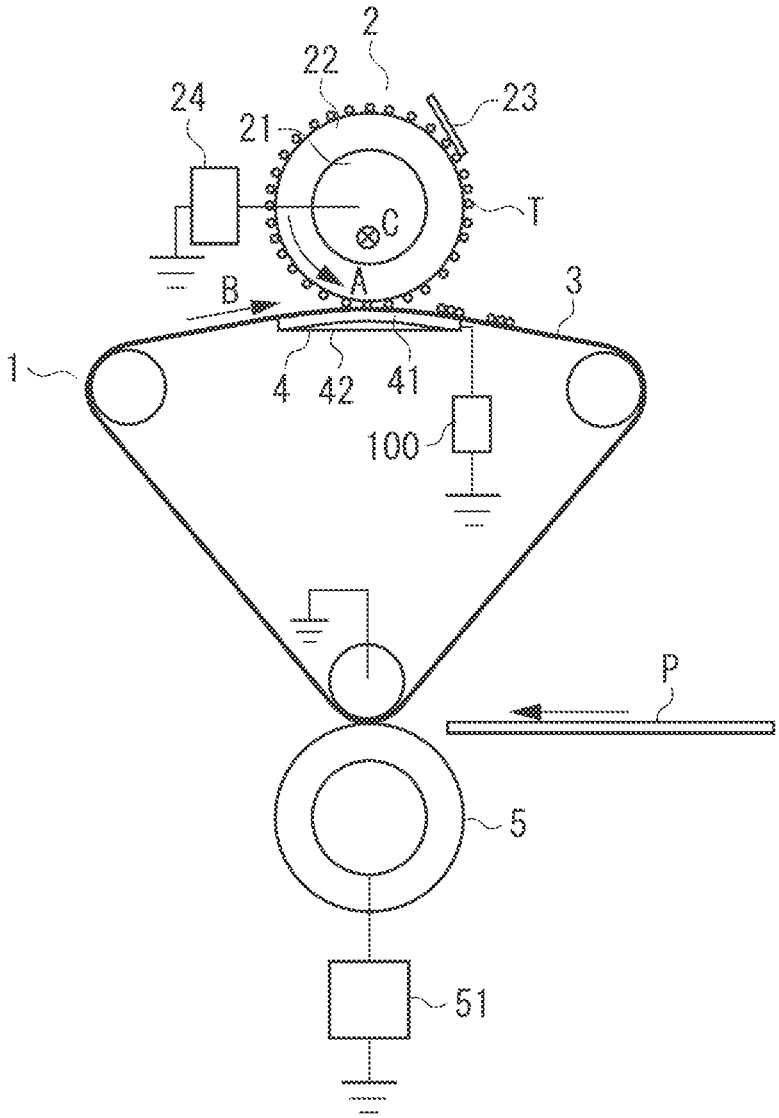
FIG. 1 is a schematic diagram illustrating a configuration of an image forming apparatus applicable to one embodiment.

Hereinafter, an exemplary embodiment will be described with reference to the drawings. FIG. 1 is a schematic diagram illustrating a configuration of an image forming apparatus applicable to the present embodiment. Toner T is supplied from a toner container (not illustrated) to a toner bearing roller 2 that is a toner bearing member. The toner T is non-magnetic one-component toner having an average particle diameter of 6 μm and negative charging polarity approximately equal to unique resistance. In the present exemplary embodiment, the toner T having negative polarity set as normal charging polarity and charging characteristics of the negative polarity is employed.

The toner bearing roller 2 rotates in a rotational direction A. The toner T is conveyed by the rotation of the toner bearing roller 2, charged to a predetermined charge amount by a blade 23, and regulated to a predetermined thickness. The toner bearing roller 2 is contacted by the blade 23 using spring elasticity of a sheet metal. In the present exemplary embodiment, a steel use stainless (SUS) plate having a thickness of 0.1 mm is employed for the blade 23.

The toner bearing roller 2 includes a core metal having an outer diameter of 6 mm as a conductive support member 21 and a conductive silicon rubber layer having an outer diameter of 11.5 mm formed as an elastic layer 22 around the core metal. The toner bearing roller 2 further includes a urethane resin layer with thickness of 10 μm coated on a surface of the conductive silicon rubber layer.

A toner bearing roller power source 24, which is connected to the conductive support member 21 of the toner bearing roller 2, is configured to apply a voltage to the toner bearing roller 2 or grounded.

An image bearing belt 3 (image bearing member) rotates in a rotational direction B along with the rotation of the toner bearing roller 2. The image bearing belt 3 is a single-layer polyimide film having a thickness of 60 μm.

Because the toner bearing roller 2 contacts the image bearing belt 3, the toner T is sandwiched and conveyed at the contact portion.

A recording electrode 4 is disposed on a side opposite the toner bearing roller 2 relative to the image bearing belt 3. The recording electrode 4 includes a planar electrode 41 and a support member 42 for supporting and fixing the planar electrode 41.

To firmly bring the planar electrode 41 into contact with the image bearing belt 3, the planar electrode 41 surface-contacts the image bearing belt 3. The surface contact stabilizes an electric field on the surface of the toner bearing roller 2 between the toner bearing roller 2 and the image bearing belt 3, thereby providing a stable line width in thin line image formation.

An image forming electrode control unit 100, which is connected to the planar electrode 41, controls a value of a voltage applied to the planar electrode 41 based on image information. In the case of the negative polarity toner, the voltage is applied to an electrode of a place in which the toner is to be printed such that the image bearing belt 3 may be set to a potential higher than the toner bearing roller 2 and the voltage is applied to an electrode of a place in which the toner is not to be printed such that the toner bearing roller 2 may be set to a potential higher than the image bearing belt 3. Accordingly, a resolved toner image is acquired by changing a bias applied to the planar electrode 41.

Thus, the toner image is formed on the image bearing belt 3. Specific conditions for the bias applied to the recording electrode 4 and the image bearing belt 3 will be described in detail below.

The toner image on the image bearing belt 3 is conveyed to a contact portion between a transfer roller 5 and the image bearing belt 3 by rotating the image bearing belt 3. A recoding material P is conveyed at timing of toner image conveyance, and sandwiched between the image bearing belt 3 and the transfer roller 5 to be conveyed together with the toner image. At that time, a transfer bias control unit 51 applies a transfer bias to the transfer roller 5, and the toner image on the image bearing belt 3 is transferred to the recording material P.

Then, by fixing the toner image on the recording material P with a fixing unit (not illustrated), the image forming process of the image forming apparatus is completed.

Figure 2:
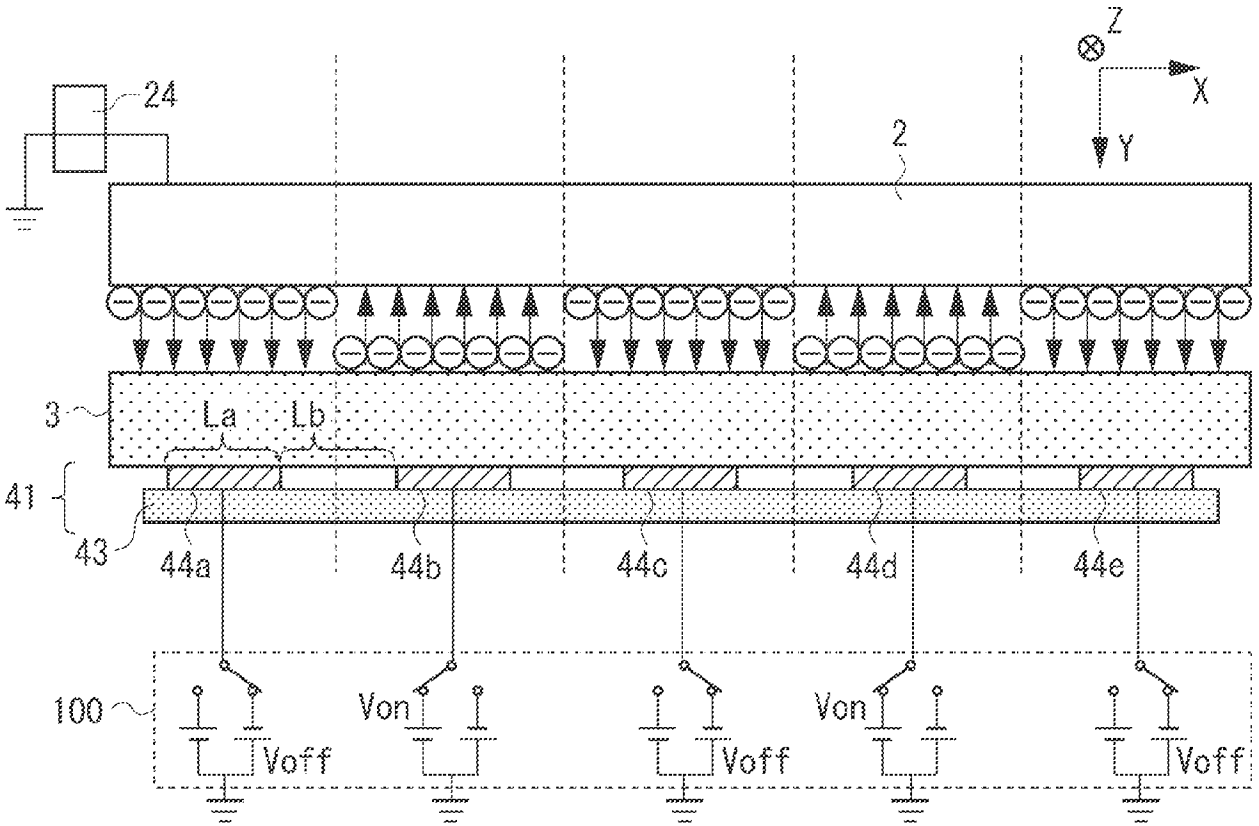
FIG. 2 is a schematic diagram illustrating a configuration of an image forming apparatus according to an exemplary embodiment.

FIG. 2 is a schematic model diagram illustrating an image forming unit seen from a downstream in a rotational direction of the image bearing belt 3.

Hereinafter, for simplicity, a direction from the toner bearing roller 2 to the recording electrode 41, namely, a downward direction illustrated in FIG. 2, is referred to as a thickness direction Y, and a direction parallel to an axis of the toner bearing roller 2, namely, a right direction illustrated in FIG. 2, is referred to as an axial direction X. The axial direction X is a direction in which electrode portions 44 are arranged side by side.

A flexible printed board is used for the planar electrode 41. The planar electrode 41 includes an electrode base material 43 and the electrode portions 44. The electrode base material 43 is made of a polyimide resin having a thickness of 25 μm, and the electrode portion 44 is made of copper having a thickness of 10 μm.

The image forming apparatus employs resolution of 300 dots per inch (dpi) in the axial direction X, so that a plurality of electrode portions is arranged at intervals of 84 μm in the axial direction X.

The electrode portions 44*a* to 44*e* are in contact with the image bearing belt 3. In the configuration of the present exemplary embodiment, a relationship between a contact width La that is a length of a contacting portion in the axial direction X and a non-contact width Lb that is a length of a non-contacting portion in the axial direction X is represented by La=Lb=42 μm.

Next, a relationship between a voltage applied to the electrode portion 44 and image formation will be described. In the present exemplary embodiment, a voltage of 50 V is applied to the toner bearing roller 2 by the toner bearing roller power source 24. A voltage of 100 V or 0 V is applied to the electrode portion 44.

An arrow illustrated in FIG. 2 indicates a direction of an electric field on the surface of the toner bearing roller 2 between the toner bearing roller 2 and the image bearing belt 3. FIG. 2 illustrates a case where voltages of 0V are applied to the electrode portions 44*a*, 44*c*, and 44*e*, while voltages of 100 V are applied to the electrode portions 44*b* and 44*d*. At the electrode portions 44*a*, 44*c*, and 44*e*, since a voltage of 50 V is applied to the toner bearing roller 2 while a voltage of 0 V is applied to the electrode portion 44, the electric field is directed in the thickness direction Y. Thus, the toner T receives a force in a direction opposite the thickness direction Y. At the electrode portions 44*b* and 44*d*, since a voltage of 50 V is applied to the toner bearing roller 2 while a voltage of 100 V is applied to the electrode portion 44, the electric field is directed in a direction opposite the thickness direction Y. Thus, the toner T receives a force in the thickness direction Y.

By such a force applied to the toner, the toner T moves to the toner bearing roller 2 side or the image bearing belt 3 side. As a result, a resolved image is formed in the axial direction X.

Hereinafter, the electrode portion 44 to which a bias causing the toner T to fly toward the image bearing belt 3 is applied, as in the case of the electrode portions 44*b* and 44*d*, will be referred to as an image forming electrode, and the bias applied at this time will be referred to as an image forming bias Von. The electrode portion 44 to which a bias causing the toner T not to fly toward the image bearing belt 3 but to remain on the toner nearing roller 2 is applied, as in the case of the electrode portions 44*a*, 44*c*, and 44*e*, will be referred to as a non-image forming electrode, and the bias applied at this time will be referred to as a non-image forming bias Voff.

Next, a case where an image may not be formed because of a relationship between a thickness $D_y$ of the image bearing belt 3 and a distance $D_x$ of the electrode portions 44 adjacent to each other in the axial direction X in the image forming process will be described.

Figure 3:
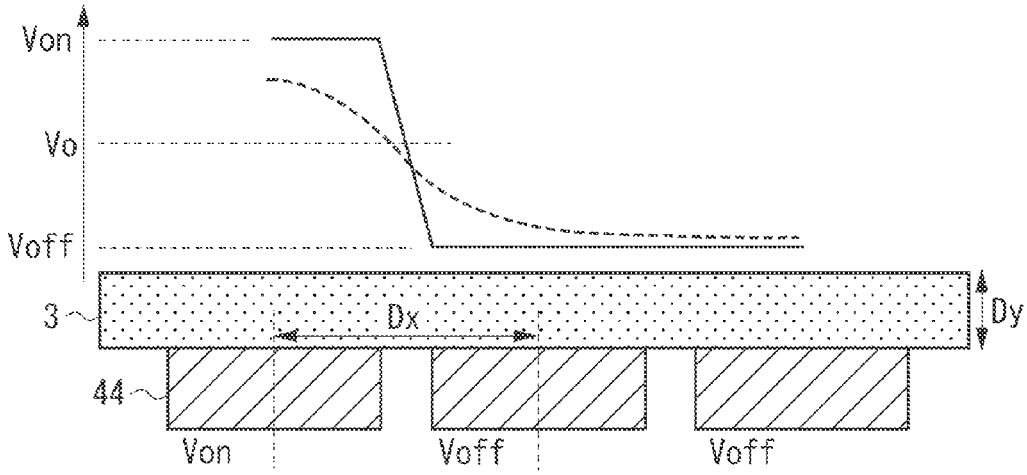
FIG. 3 is a schematic model diagram illustrating a relationship between a thickness of an image bearing belt and a surface potential of the image bearing belt in an image process.

FIG. 3 is a schematic diagram illustrating a relationship between the thickness of the image bearing belt 3 and a surface potential of the image bearing belt 3. This is a case where there is one image forming electrode and two non-image forming electrodes adjacent to the image forming electrode and thereafter. A potential Vo is set at the tonner bearing roller 2.

For simplicity, FIG. 3 illustrates the thickness $D_y$ of the image bearing belt 3 and the distance $D_x$ between the electrode portions 44 adjacent to each other in the axial direction X.

Assuming a relationship of $D_y \ll D_x$ between $D_x$ and $D_y$, a surface potential of the image bearing belt 3 directly above the image forming electrode is approximately equal to that of the image forming bias Von, and a surface potential of the image bearing belt 3 directly above the non-image forming electrode is approximately equal to that of the non-image forming bias Voff. Accordingly, a potential distribution is as indicated by a solid line illustrated in FIG. 3. However, when Dx is smaller or Dy is larger, the surface potential of the image bearing belt 3 directly above the image forming electrode decreases as indicated by a broken line illustrated in FIG. 3.

Thus, when the reduction of the potential distribution is conspicuous, the surface potential of the image bearing belt 3 directly above the image forming electrode will soon drop below that of the toner bearing roller 2. When the potential drops, a direction of electric field intensity between the toner bearing roller 2 and the image bearing belt 3 is reversed. Thus, a force applied to the toner is accordingly reversed. Since a force is applied to the toner toward the toner bearing roller 2, the toner may not fly to the image bearing belt 3 side.

Such a phenomenon, i.e., the surface potential of the image bearing belt 3 changes without changing the bias applied to the electrode portion 44, depends on not only the thickness of the image bearing belt 3 as described above but also the contact width La of the electrode portion 44. Specifically, as the contact width of the electrode portion 44 is larger, the surface potential of the image bearing belt 3 directly above the image forming electrode is higher.

The phenomenon also depends on the image information. For example, in the case of image formation where the image forming electrode is continuous, it is difficult for the surface potential of the image bearing belt to drop. However, when the non-image forming electrode continues adjacent to the image forming electrode, the surface potential of the image bearing belt 3 directly above the image forming electrode easily drops.

In the image forming process, the image information makes image formation difficult when there is one image forming electrode and non-image forming electrodes continue adjacent to and after the image forming electrode, in other words, when thin-line image formation is carried out. Thus, the configuration of the present exemplary embodiment was checked whether thin-line formation is possible. The thin line means image information where one image forming electrode and three non-image forming electrodes are alternately present. The thin line is image information where image formation is relatively difficult in the image forming process.

In the present exemplary embodiment, a single-layer polyimide film where a thickness of the image bearing belt 3 is 60 μm, resistance in the axial direction X is $3.62\times10^{10}\Omega$, and resistance in a thickness direction Y is $9.25\times10^{5}\Omega$ is used. In this configuration, thin-line image formation may be carried out. On the other hand, in a comparison example 1 of a single-layer polyimide film having a thickness of 100 μm and a comparison example 2 of a single-layer polyvinylidene fluoride film formed with a thickness of 60 μm by extrusion molding, thin-line image formation was not possible.

In the comparison example 1, resistance in the axial direction X is $2.21\times10^{10}\Omega$, and resistance in a thickness direction Y is $1.58\times10^{6}\Omega$. In the comparison example 2, resistance in the axial direction X is $4.09\times10^{8}\Omega$, and resistance in a thickness direction Y is $1.19\times10^{5}\Omega$. A measurement method of the resistance will be described in detail below.

In the present exemplary embodiment, the polyimide is employed as a material for the image bearing belt 3. However, the material for the image bearing belt 3 is not limited to the polyimide. In place of the polyimide, polycarbonate (PC), polyvinylidene fluoride (PVDF), polytetra fluoro ethylene polymer (PTFE), or polyamide may be used.

In the present exemplary embodiment, in the image information where image formation by the image forming method is difficult, the image bearing belt 3 is defined to carry out good image formation. In this case, by taking into account a case where the contact width of the electrode portion 44 with the image bearing belt 3 is configured to be large as much as possible, requisite conditions of the image bearing belt 3 to be satisfied for image formation are acquired. Then, it will be shown that the conditions are satisfied in the present exemplary embodiment, while they are not satisfied in the comparison examples 1 and 2.

Thus, as to the image information where the image formation is difficult, definition of the image bearing belt 3 for carrying out good image formation was analyzed by simulation.

Numerical calculation is carried out by using a computer, and conditions to be set in the image bearing belt 3 according to the present exemplary embodiment are acquired by numerical value experiment. The used computer is as follows: a central processing unit (CPU) is Intel Xenon processor, a clock frequency is 3.06 GHz, an architecture is FSB 533, a cache capacity is 512 KB, a memory is DDR SDRAM 2 GB, and a hard disk is Ultra ATA 133 160 GB.

Concerning a method of the numerical value calculation, a method discussed in Japanese Patent Application Laid-Open No. 2005-345119 was used, and thus description thereof is omitted. In the simulation, a potential that is an unknown variable is calculated by taking electric conduction into account. For the potential calculation, a two-dimensional finite element method was used.

An element division diagram was created to calculate a potential by the finite element method. The element division diagram is a set of primary square elements. The electrode portion 44 was not filled with any elements because it was regarded as a conductor. A surface of the electrode portion 44 was set as a fixed boundary surface, and a potential was applied to the image forming electrode control unit 100.

Poisson equation was calculated under the aforementioned conditions. In this case, in a bias applied state, potentials of all nodes of the element division diagram were calculated according to a dielectric constant of the image bearing belt 3. A specific dielectric constant of the image bearing belt 3 was converted into a specific dielectric constant with respect to a vacuum dielectric constant to be set to 3.

First, image information to be evaluated is acquired by simulation. The evaluation image information is determined by using a simulation result when the number of non-image forming electrodes is changed while the number of image forming electrodes is fixed to one.

A configuration of the image forming apparatus in the simulation is similar to that of the present exemplary embodiment, and thus description thereof is omitted.

The simulated image information is expressed in a form of [i, j]: i indicating the number of image forming electrodes, and j indicating the number of non-image forming electrodes. In other words, [1, 4] represents image information where there is one image forming electrode and there are four non-image forming electrodes on each of both sides thereof.

For simplicity, the image bearing belt 3 has a surface potential V(x): x indicating a position in the axial direction X, and an original point is a center position of the image forming electrode. Accordingly, at the center position of the image forming electrode, the image bearing belt 3 has a surface potential V(x=0).

Figure 4:
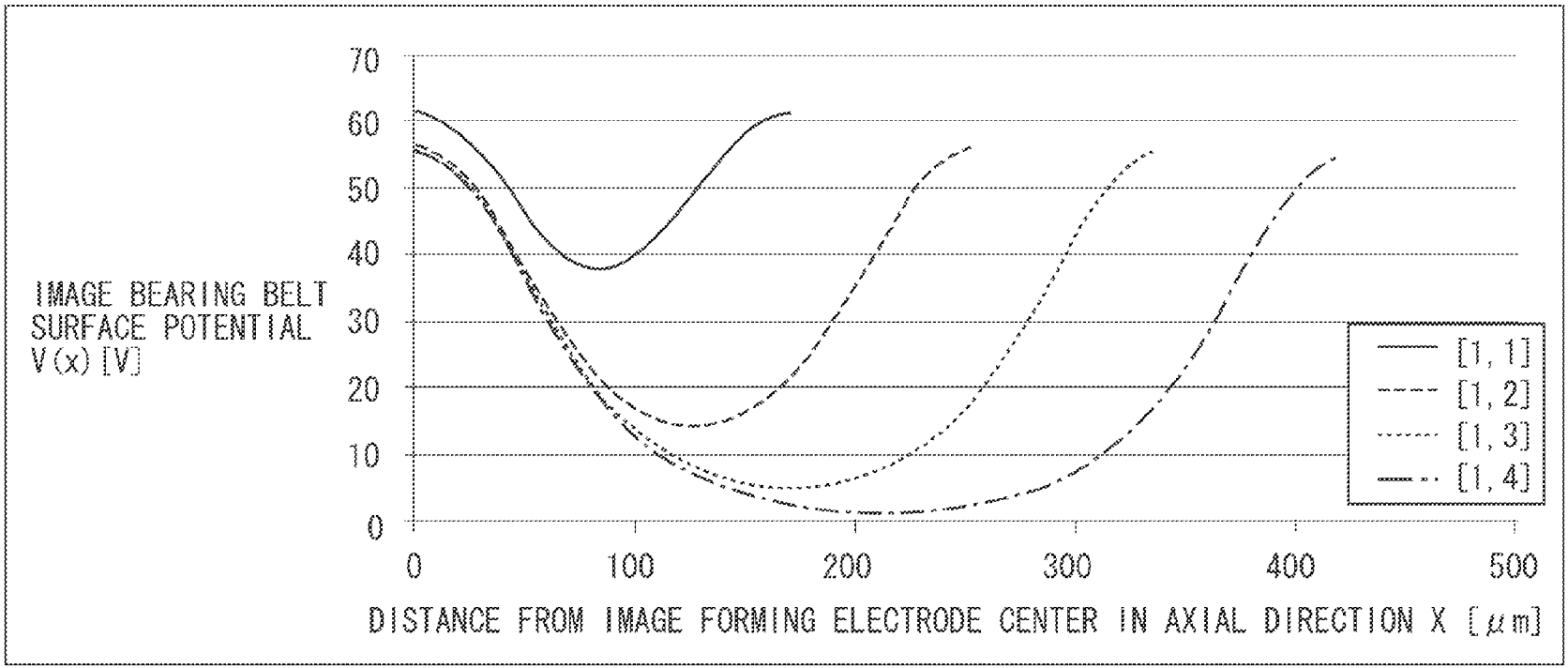
FIG. 4 is an explanatory diagram illustrating a simulation result of an influence of image information on the image bearing belt surface potential.

FIG. 4 is a graph illustrating a surface potential V(z) for each image information. Pieces of image information [1, 1], [1, 2], [1, 3], and [1, 4] are illustrated. To define a periodic boundary, image forming electrodes are respectively arranged at the original point and a right end illustrated in FIG. 4. Accordingly, in FIG. 4, image bearing belt surface potentials V(x) are larger at both ends while image bearing belt surface potential V(x) is smaller near the non-image forming electrode at the center. When the number of non-image forming electrode increases, a surface potential V(x) is reduced.

Figure 5:
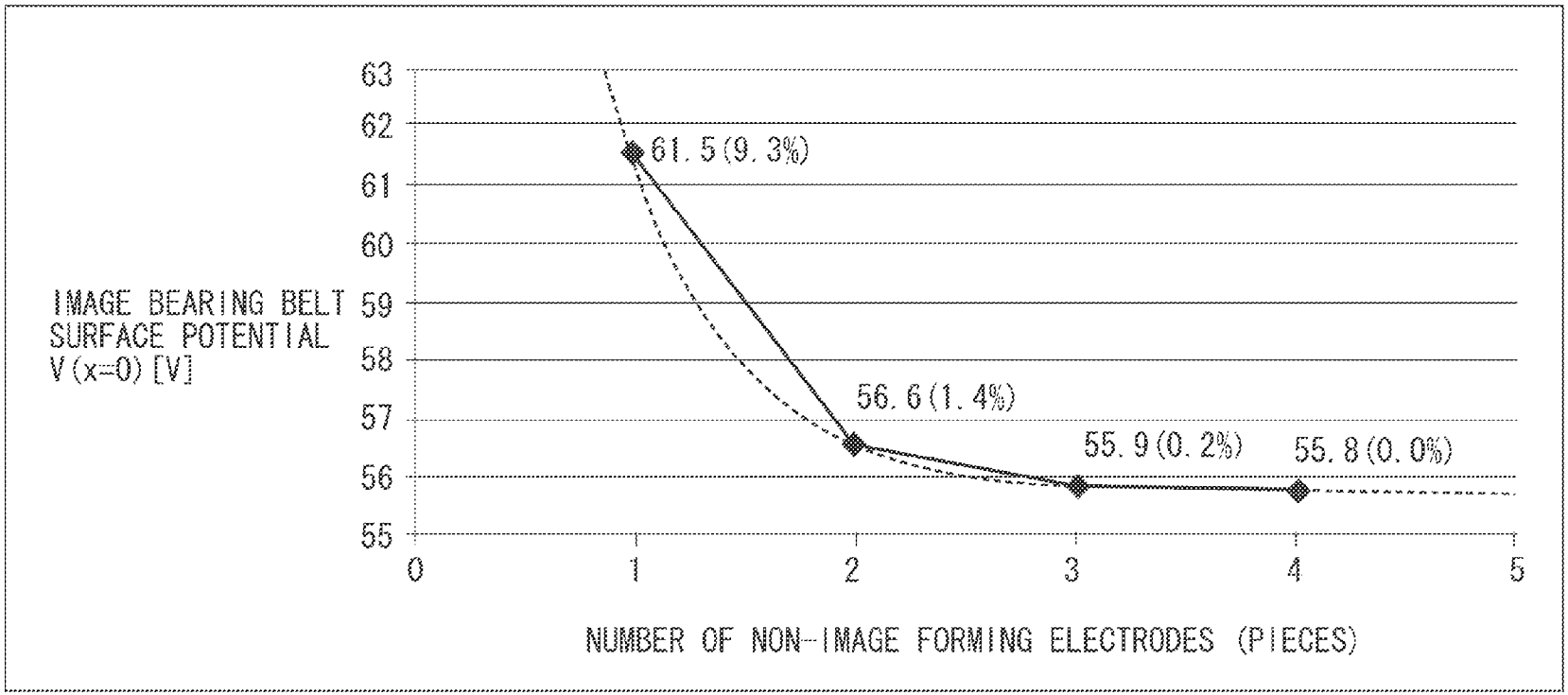
FIG. 5 is an explanatory diagram illustrating a simulation result concerning an influence of image information on the image bearing belt surface potential in an image forming electrode center position.

FIG. 5 illustrates only a surface potential V(x=0) among those illustrated in FIG. 4. A broken line indicates an approximate curve when plots are approximated by an exponential function. A numeral on the plot is a value of V(x=0), and a numeral in a bracket indicates a difference from an approximate value approximated by the exponential function, with a ratio.

This result shows that a ratio of a difference from the approximate value is 0.2% when three non-image forming electrodes continue and sufficient saturation has occurred. Accordingly, thereafter, to define the image bearing belt 3, [1, 3] is employed as image information where sufficient image formation is difficult.

The simulation based on the two-dimensional finite element method may not be carried out in a case where resistivity in the axial direction X and resistivity in the thickness direction Y are different from each other, and thus another simulation method is used.

Figure 6A:
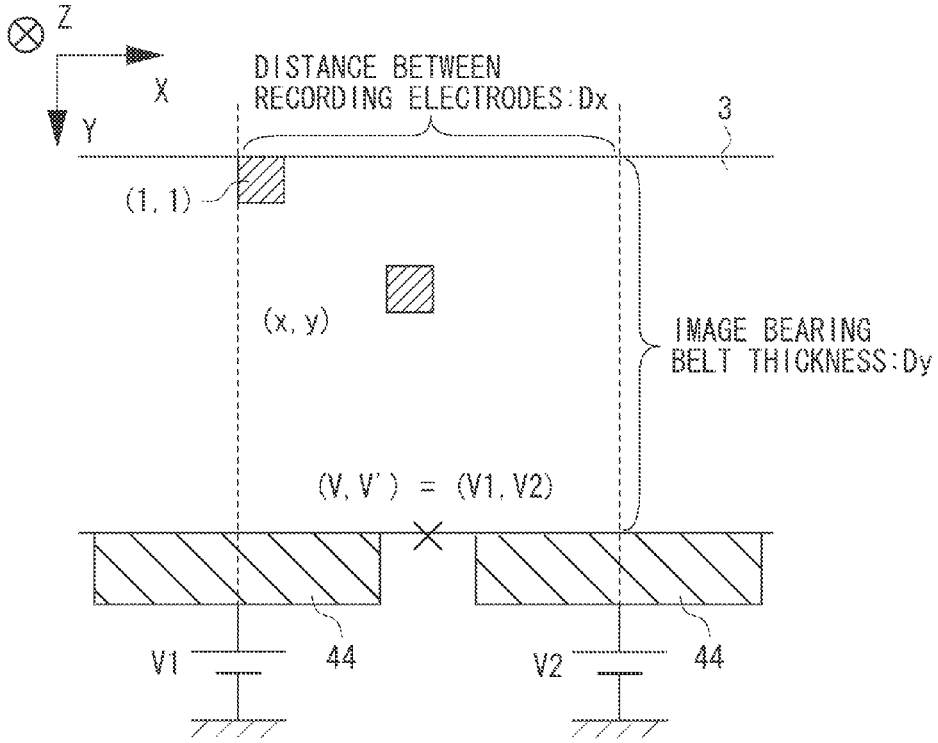
FIGS. 6A and 6B are explanatory schematic model diagrams illustrating a simulation model in simulation of the image bearing belt surface potential.
Figure 6B:
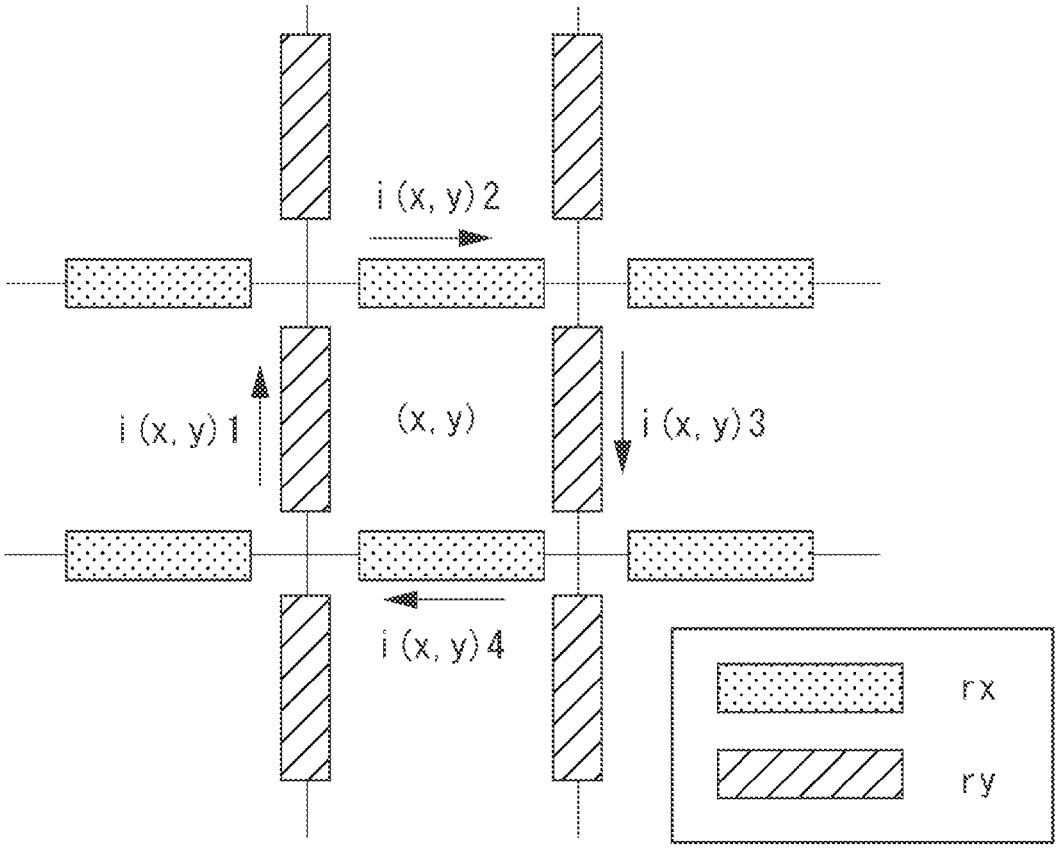

FIGS. 6A and 6B illustrate calculation models. FIG. 6A is a schematic model diagram illustrating the image forming unit seen from a downstream in the rotational direction of the image bearing belt 3. As a calculation model, the thickness $D_y$ of the image bearing belt 3 is divided into N and the distance $D_x$ between the electrode portions 44 in the axial direction X is divided into N to constitute one element.

Taking a resistance component between the nodes into account, a resistance component in the thickness direction Y is represented by $r_y$, and a resistance component in the axial direction X is represented by $r_x$.

The surface of the image bearing belt 3 at the center position of the image forming electrode in the image information [1, 3] is set as the original point. Among elements adjacent to the original point, the element on the right side illustrated in FIG. 6A is represented by an index (1, 1). In FIG. 6A, a right direction is a positive direction in the axial direction X, and a downward direction is a positive direction in the thickness direction Y. Non-image forming electrodes are present on both sides of the image forming electrode. However, simulation is carried out only for the positive direction in the axial direction X because of symmetry.

FIG. 6B illustrates an element (x, y). This is an element x-th in the positive direction in the axial direction X, and y-th in the positive direction in the thickness direction Y. Current values flowing through the respective resistance components in the element (x, y) are defined as $i(x, y)_1$, $i(x, y)_2$, $i(x, y)_3$, and $i(x, y)_4$ clockwise from the left. With respect to these current values, a clockwise direction in each element is positive. Thus, $i(x, y)_2=-i(x, y-1)_4$ or $i(x, y)_3=-i(x+1, y)_1$ are established.

In the case of the image information [1, 3], 4×N×N elements are present. For each element, Kirchhoff's Law is applied to create a simultaneous equation for the 4×N×N $i(\ldots,\ldots)_2$. Thus, V(x=0) is acquired.

First, to create a simultaneous equation, general terms are considered. When Kirchhoff's Law is applied to the element (x, y), the following is established:

$$i(x,y)_1 r_y + i(x,y)_2 r_x + i(x,y)_3 r_y + i(x,y)_4 r_x = 0$$

The elements $i(x, y)_1$ or and $i(x, y)_3$ are replaced with only a current value of a component of 2 using following equations:

$$i(x, y)_1 = \sum_{k=1}^{y} (i(x, k)_2 - i(x-1, k)_2)$$

$$i(x, y)_3 = -i(x+1, y)_1 = \sum_{k=1}^{y} (-i(x+1, k)_2 + i(x, k)_2)$$

Thus, the general terms are as follows:

$$\alpha i(x, y)_2 + \alpha i(x, y)_4 + \sum_{k=1}^{y} [-i(x-1, k)_2 + 2i(x, k)_2 - i(x+1, k)_2] = 0 \quad (1)$$

In this case, $\alpha=r_x/r_y$ is defined. A component of 4 in the second term of the equation is also replaced with the component of 2 when a value of y is incremented by 1. Thus, when y≠N, all the terms are replaced with the component of 2. A coefficient in the equation (1) includes only the constant α, and accordingly V(x=0) depends on α.

Next, a case of y=N will be described. A contact width of the electrode portion 44 with the image bearing belt 3 is set as large as possible. Accordingly, only one of the N elements of y=N does not contact the electrode portion 44. When N is always set odd to locate the non-mage forming electrode at the center position of the electrode portions 44 adjacent to each other, the element of (x, y)=((N+1)/2, N) does not contact the electrode. In the elements contacting the electrode portion 44, because of equal potentials, $i(x, N)_4=0$ is established. For the element which does not contact the electrode portion 44, the equation (1) is substituted with the following equation (3). For simplicity, $x_0(N+1)/2$ is set.

$$\alpha i(x_0, N)_2 + \alpha\frac{(V' - V)}{r_x} + \sum_{k=1}^{N}[-i(x_0 - 1, k)_2 + 2i(x_0, k)_2 - i(x_0 + 1, k)_2] = 0 \quad (2)$$

A bias V is applied to the electrode portion 44 nearest to an element ($x_0$, N) among the electrode portions 44 located in a negative direction in the axial direction X with respect to the element ($x_o$, N). A bias V' is applied to the electrode portion 44 nearest to the element ($x_0$, N) among the electrode portions 44 located in a positive direction in the axial direction X with respect to the element ($x_o$, N). For example, at the node of an x mark illustrated in FIG. 6A, (V, V')=($V_1$, $V_2$) is set. Near the original point in [1, 3], V is the image forming bias Von, and V' is the non-image forming bias Voff.

Thus, a simultaneous equation may be created for 4×N×N components of 2 ( . . . , , , , )$_2$. As a result, V(x) is acquired.

First, image forming bias Von dependency will be described. In this case, image formation of [1, 3] is simulated and compared, with image forming biases Von set to 80 V, 90 V, 100 V, 110 V, and 120 V. A number of divisions is N=21.

Table 1 shows an examined configuration.

TABLE 1

| | α | Von [V] | Voff [V] |
|---|---|---|---|
| Condition 1 - 1 | 2.0 | 80 | 0 |
| Condition 1 - 2 | 2.0 | 90 | 0 |
| Condition 1 - 3 | 2.0 | 100 | 0 |
| Condition 1 - 4 | 2.0 | 110 | 0 |
| Condition 1 - 5 | 2.0 | 120 | 0 |

Figure 7:
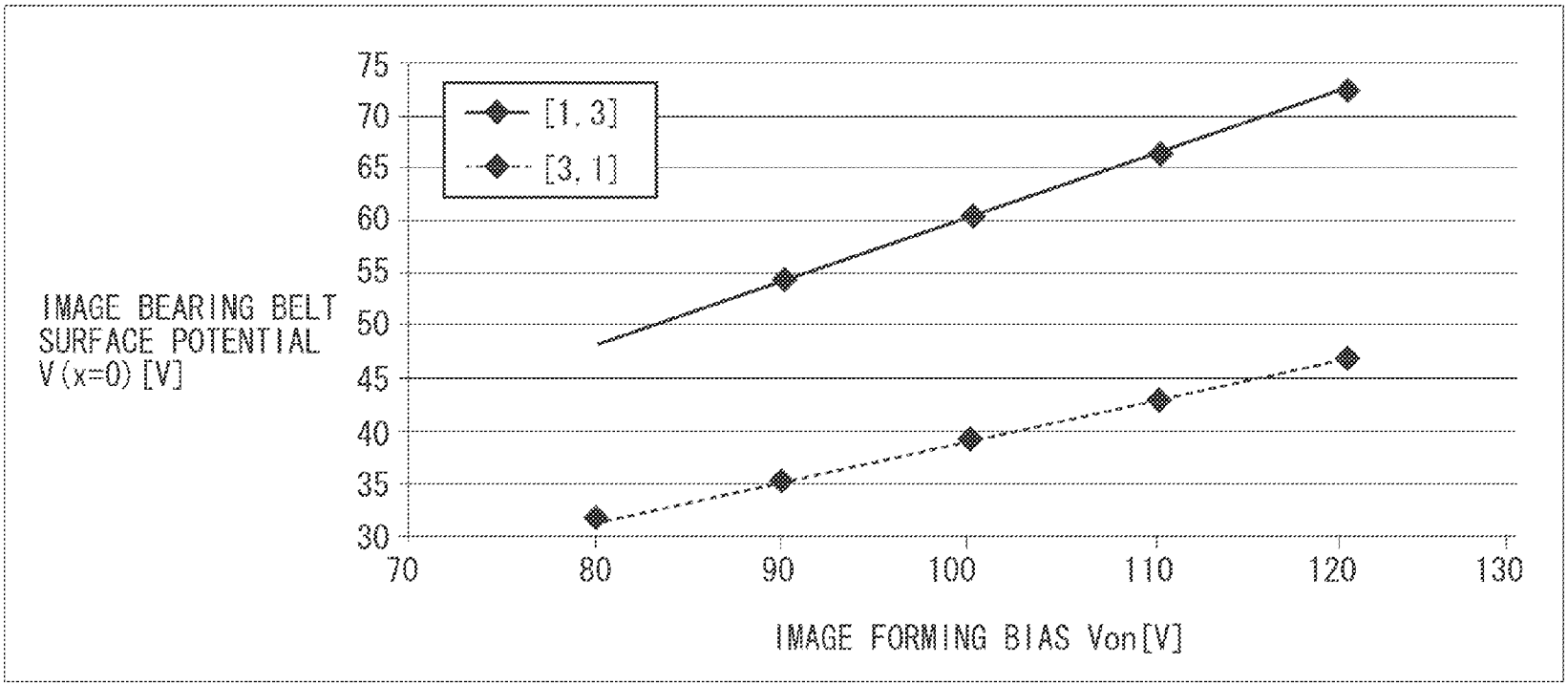
FIG. 7 is an explanatory diagram illustrating a simulation result concerning an influence of an image forming bias on the image bearing belt surface potential.

A solid-line plot illustrated in FIG. 7 is V(x=0) in the configuration of the present exemplary embodiment and the examined configuration. When the image forming bias Von increases, V(x=0) also increases. Thus, to set V(x=0) larger than the potential VO of the toner bearing roller 2, the image forming bias Von only needs to be increased. In other words, to form [1, 3], the potential VO of the toner bearing roller must be reduced.

Only the image information [1, 3] has been described. Next, image forming bias dependency in the case of the image information [3, 1] will be described. As in the case of the image information [1, 3], simulation and comparison are carried out in the configuration of the Table 1.

A broken-line plot illustrated in FIG. 7 is V(x=0) in the examined configuration of the Table 1. In this case, the original point is a non-image forming electrode center position. In other words, V(x−0) indicates a surface potential of the image bearing belt 3 at the non-image forming electrode center position.

When the image forming bias Von increases, V(x=0) also increases. V(x=0) on the non-image forming electrode must be smaller than the potential VO of the toner bearing roller 2. Thus, to form [1, 3], the image forming bias Von must be reduced as much as possible. In other words, the potential VO must be increased to form [3, 1].

The potential VO must be reduced to form the image of [1, 3], and the potential VO of the toner bearing roller 2 must be increased to form the image of [3, 1]. Thus, by establishing both [1, 3] and [3,1], a margin of the potential VO of the toner bearing roller 2 is determined.

Next, how the margin of the potential VO of the toner bearing roller 2 is changed by α of the image bearing belt 3 and the image forming bias Von, will be described. The number of divisions is N=21.

Figure 8:
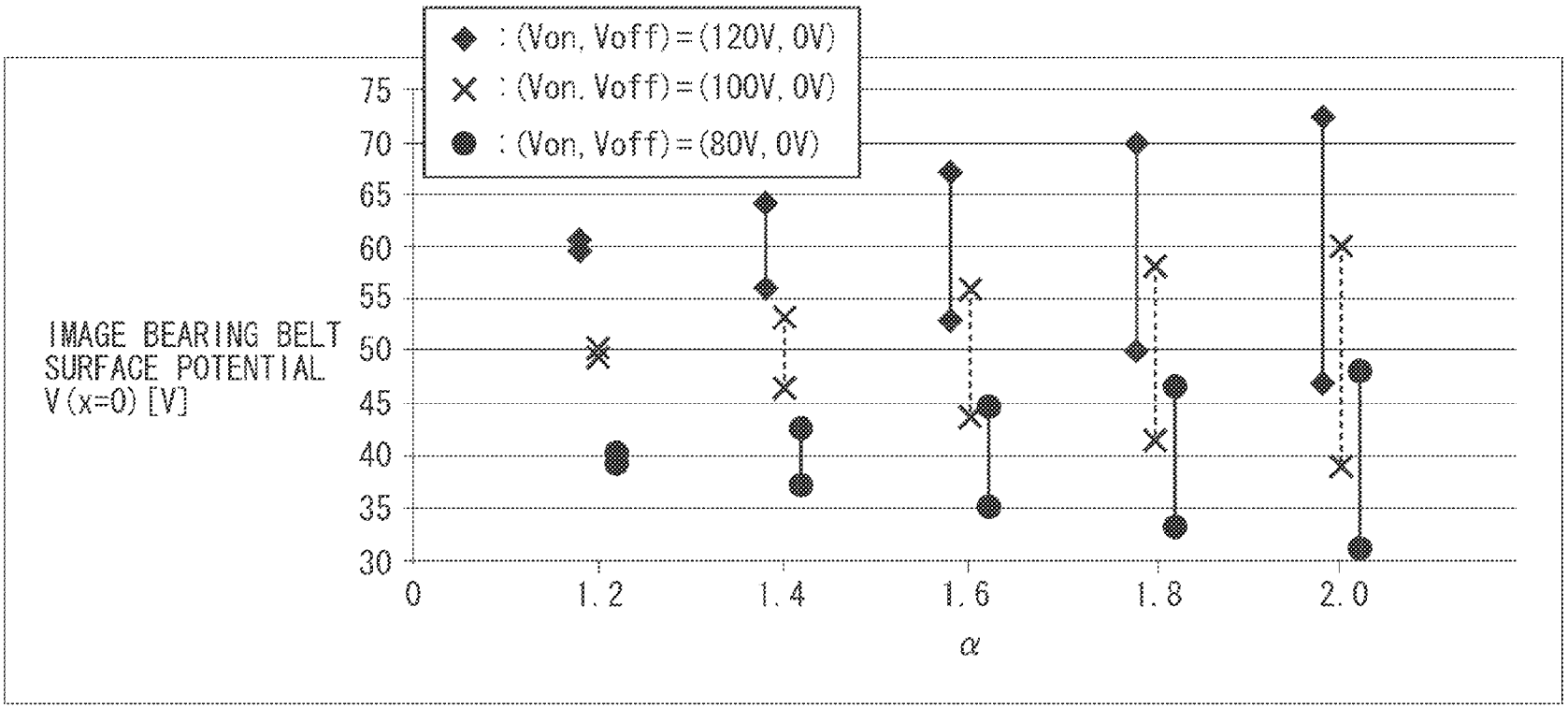
FIG. 8 is an explanatory diagram illustrating a simulation result concerning an influence of $\alpha$ on a margin taken by a toner bearing roller application bias.

FIG. 8 illustrates a margin of the potential VO of the toner bearing roller 2 acquired by simulation of [1, 3] and [3, 1] in a configuration of a Table 1 below. In the Table 2, elements similar to those examined thus far are denoted by similar names.

TABLE 2

| | α | Von [V] | Voff [V] |
|---|---|---|---|
| Comparative example 2 - 1 - 1 | 1.2 | 80 | 0 |
| Comparative example 2 - 1 - 2 | 1.2 | 100 | 0 |
| Comparative example 2 - 1 - 3 | 1.2 | 120 | 0 |
| Condition 2 - 2 - 1 | 1.4 | 80 | 0 |
| Condition 2 - 2 - 2 | 1.4 | 100 | 0 |
| Condition 2 - 2 - 3 | 1.4 | 120 | 0 |
| Condition 2 - 3 - 1 | 1.6 | 80 | 0 |
| Condition 2 - 3 - 2 | 1.6 | 100 | 0 |
| Condition 2 - 3 - 3 | 1.6 | 120 | 0 |
| Condition 2 - 4 - 1 | 1.8 | 80 | 0 |
| Condition 2 - 4 - 2 | 1.8 | 100 | 0 |
| Condition 2 - 4 - 3 | 1.8 | 120 | 0 |
| Condition 1 - 1 | 2.0 | 80 | 0 |
| Condition 1 - 3 | 2.0 | 100 | 0 |
| Condition 1 - 5 | 2.0 | 120 | 0 |

FIG. 8 illustrates a relationship between α and the image bearing belt surface potential V(x=0). Non-image forming biases Voff are all 0 V, a plot of ♦ is Von=120 V, a plot of x is Von=100 V, and a plot of ○ is Von=80 V. An upper plot of each condition is V(x=0) in [1, 3], and a lower plot is V(x=0) in [3, 1]. Between these plots, a margin to be taken by the potential Vo of the toner bearing roller 2 is set.

The margin of the potential Vo is gradually narrowed to disappear in due course as α becomes smaller. In other words, [1,3] and [3, 1] are not simultaneously established as α becomes smaller.

A condition that the margin of potential Vo of the toner bearing roller 2 becomes one point is a boundary for determining whether to enable image formation by the image forming method according to the present exemplary embodiment. A size when the margin of potential Vo of the toner bearing roller 2 becomes one point is an intermediate value between Von and Voff because of symmetry. Further, when the margin of potential Vo of the toner bearing roller 2 becomes one point, α does not depend on the image forming bias Von. Thus, by setting Vo to the intermediate value between Von and Voff, a condition to enable the image forming method of the present exemplary embodiment to perform image formation may be defined by α without any dependence on Von, Voff, and Vo.

The increase of α means that $r_y$ is set smaller than $r_x$. This may be achieved by reducing the thickness of the image bearing belt 3. Specifically, the margin of the potential Vo of the toner bearing roller 2 is enlarged by reducing the thickness of the image bearing belt 3. In other words, when $r_x$ is constant, an upper limit to the thickness of the image bearing belt 3 exists.

Figure 9:
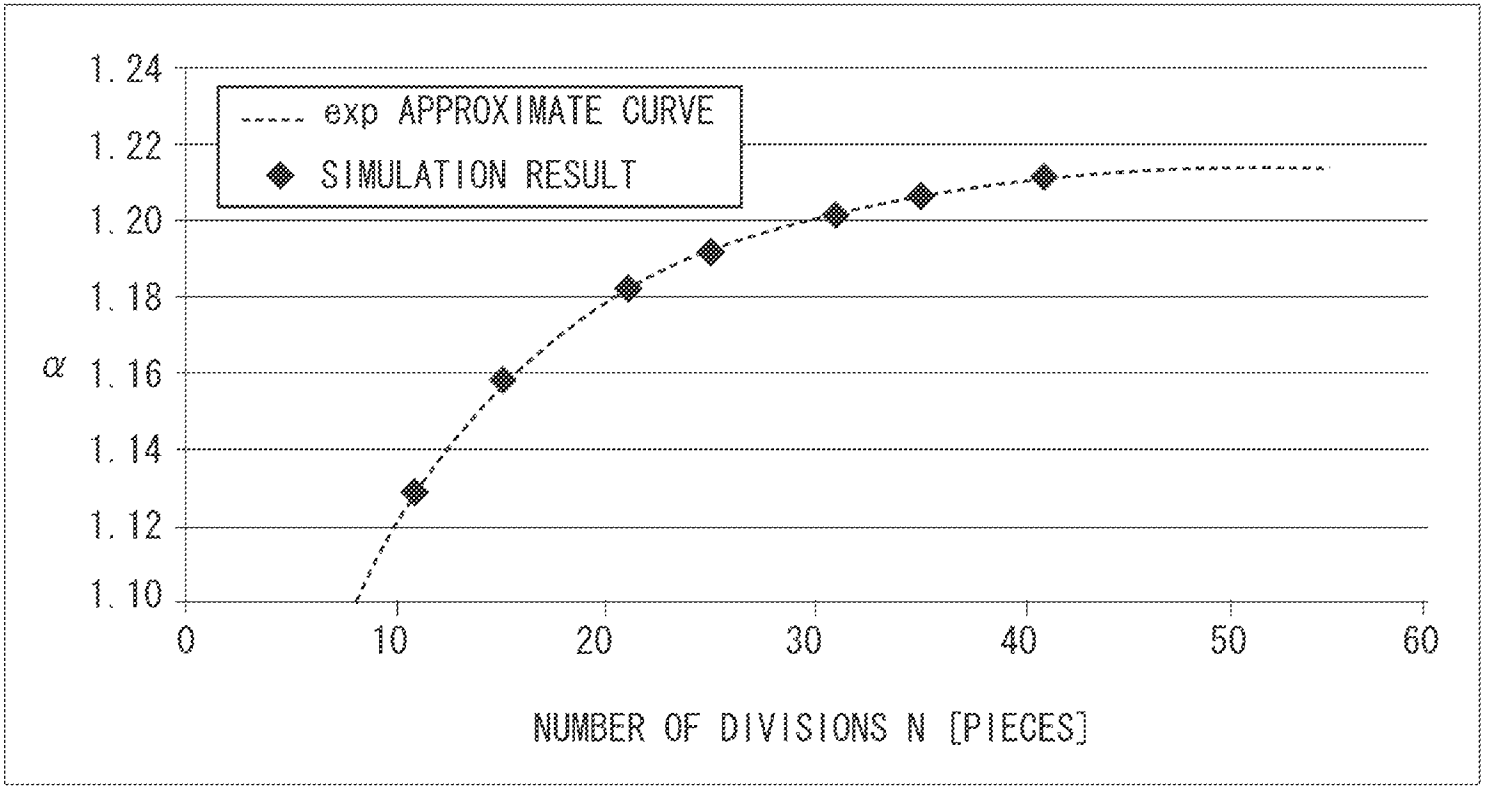
FIG. 9 is an explanatory diagram illustrating a simulation result concerning an influence of the number of divided simulation models on $\alpha$ when the image bearing belt surface potential in the image forming electrode center position is equal to a toner bearing roller potential.

FIG. 9 illustrates a relationship set between the number of divisions N and α of V(x=0)=Vo(=50 V) to acquire conditions of α.

The increase of the number of elements means that the contact range of the electrode portion 44 with the image bearing belt 3 is widened in addition to the reduction of a distance between the nodes.

In the graph, a broken line indicates a curve approximated by an exponential function. When the number of elements increases, a value of $\alpha$ is saturated at 1.22. Thus, a condition of the image bearing belt 3 to be taken for image formation in the image forming apparatus is $\alpha>1.22$.

Next, a measurement method of the image bearing belt 3 will be described. As described above, $\alpha=r_x/r_y$ is set. In this case, $r_x$ and $r_y$ are respectively a resistance component in the axial direction X and a resistance component in the thickness direction Y when the image bearing belt 3 is divided into N in the thickness direction Y and a portion between the electrode portions 4 is divided into N in the axial direction X. Accordingly, $\alpha$ of the image bearing belt 3 is acquired by measuring resistance in the thickness direction Y and resistance in the axial direction X.

Figure 10:
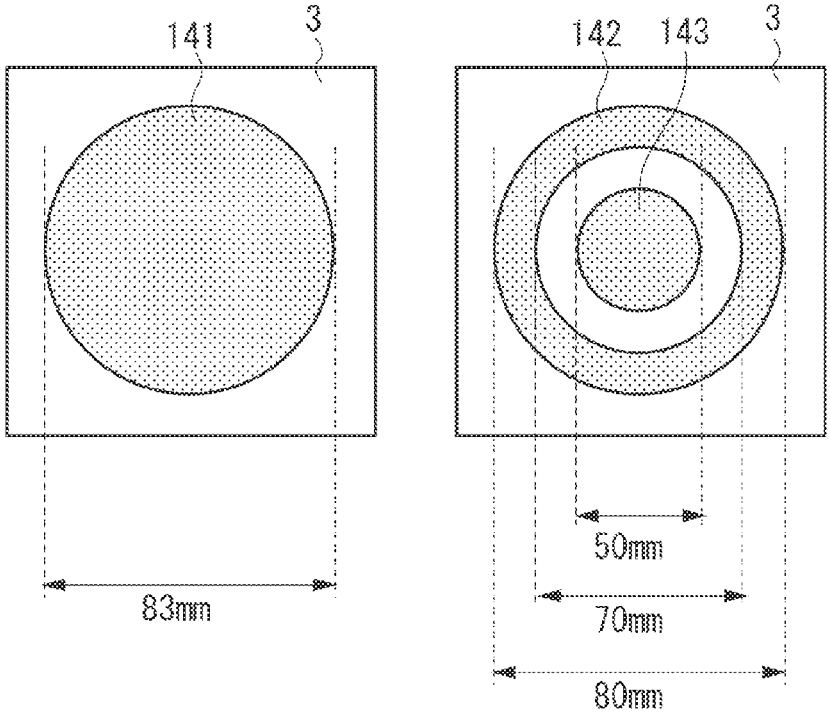
FIG. 10 is an explanatory schematic diagram illustrating a double-ring electrode for image bearing belt resistance measurement.

FIG. 10 illustrates electrodes used for resistance measurement. As a resistance measurement method, resistivity testing based on a double-ring electrode method of JISK 6911, or its equivalent, is employed. Concerning sizes of the electrodes, an outer diameter of the electrode 141 is 83 mm, an outer diameter of the electrode 142 is 80 mm, an inner diameter of the electrodes 142 is 70 mm, and an outer diameter of the electrode 143 is 50 mm.

Figure 11A:
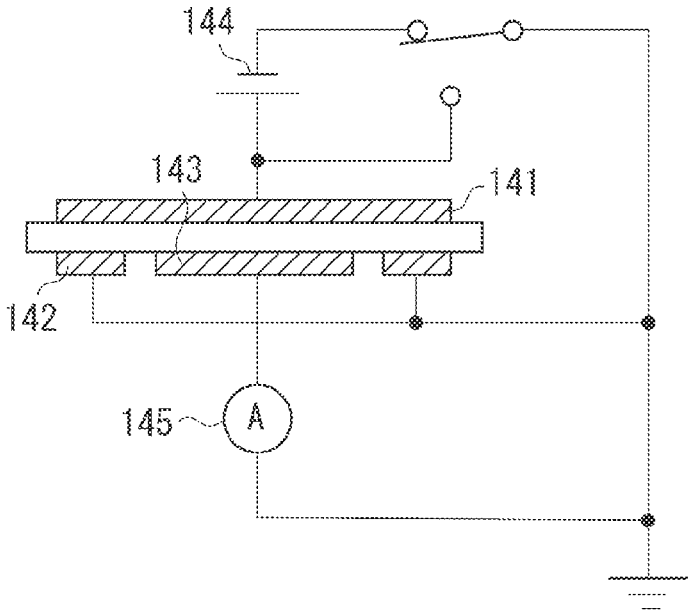
FIGS. 11Aa and 11B are explanatory schematic diagrams illustrating wiring for image bearing belt resistance measurement.
Figure 11B:
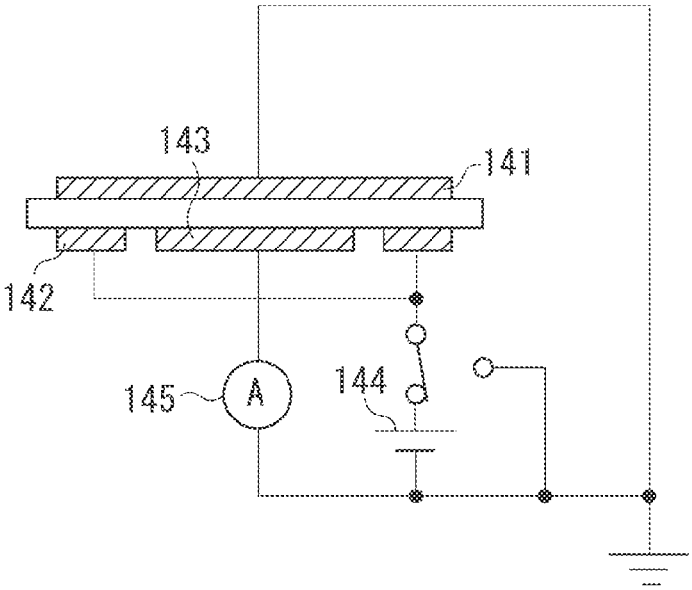
Figure 12:
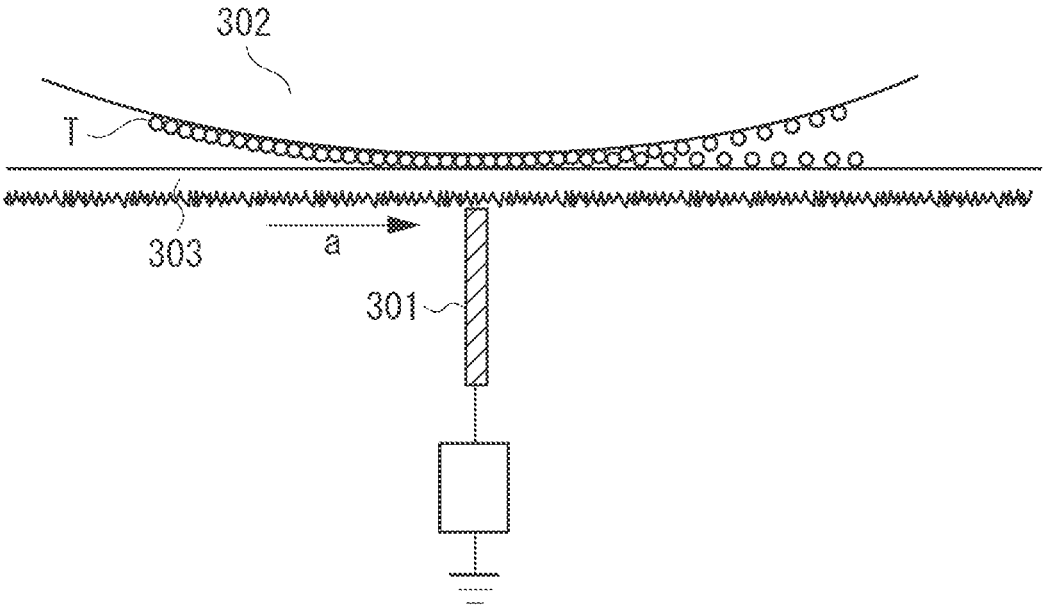
FIG. 12 (PRIOR ART)
FIG. 12 is an explanatory schematic model diagram illustrating an image forming unit according to a conventional example.

FIGS. 11A and 11B are diagrams illustrating wiring for resistance measurement: FIG. 11A illustrates the wiring for measuring resistance in the thickness direction Y, and FIG. 11B illustrates the wiring for measuring resistance in the axial direction X.

In the resistance measurement in the axial direction X, a value larger by 120 times than that in the resistance measurement in the thickness direction Y must be employed as a measurement voltage. A reason is as follows.

In the image forming apparatus according to the present exemplary embodiment, resolution is 300 dpi, and an interval between the adjacent electrode portions 44 is 84 μm. In FIG. 10, a distance between the electrode 142 and the electrode 143 is 10 mm. Since sizes of both electrodes are different from each other by 120 fold, when equal biases are applied to the electrodes, a 120-fold difference is generated in electric field intensity between the electrodes. Thus, in consideration of electric field dependency of the image bearing belt 3, for the resistance measurement in the axial direction X, a value larger by 120 fold than that for the resistance measurement in the thickness direction Y must be employed as a measurement voltage.

In this case, measurement voltages of 1 V and 120 V are respectively employed for the resistance measurement in the thickness direction Y and the resistance measurement in the axial direction X. In the present exemplary embodiment, since the relationship between the interval of the electrode portions and the distance between the electrodes 142 and 143 of the ring electrode is approximately a 120-fold difference, a relationship between the measurement voltage for resistance measurement in the thickness direction Y and resistance measurement in the axial direction X is set to a 120-fold difference. Thus, a ratio of the measurement voltages is adjusted according to a ratio of the interval of the electrode portions and the distance between the electrodes 142 and 143 of the ring electrode.

Resistance Ry in the thickness direction Y and resistance Rx in the axial direction acquired by the measurement method must be calculated because sectional areas and lengths of current passage are different from those of rx and ry. The resistance Rx in the axial direction X is resistance in a direction that the electrode portions are arranged adjacent to each other.

First, in one element of the calculation model illustrated in FIG. 6, resistance components in the axial direction X and the thickness direction Y in a rectangular solid body element, considering a unit length in a vertical direction Z are, respectively set to $r'_x$ and $r'_y$. The vertical direction Z is a direction to paper surface from above and vertical to the axial direction X and the thickness direction Y illustrated i FIG. 6. In this case, in N>>1, $r_x=r'_x$, $r_y=r'_y$.

Next, a rectangular solid body element in the image bearing belt 3 is considered which has a unit length in the image bearing belt vertical direction Z, a length Dx in the axial direction $D_x$, and a length $D_y$ in the thickness direction. When a resistance component in the axial direction X is $r_x''$ and a resistance component is $r_y''$ in the thickness direction Y, of this rectangular solid body element, $r_x''$ is represented by the following equation:

$$r''_x = \rho_x \frac{D_x}{D_y} = \rho_x \frac{d_x}{d_y} = r'_x = r_x \tag{3}$$

In this case, $d_x=D_x/N$ and $d_y=D_y/N$, which are lengths in the axial direction X and the thickness direction Y of the element illustrated in FIG. 6, respectively. The element has resistivity of $\rho_x$ in the axial direction of the image bearing belt 3. Similarly, $r''_y=r_y$.

Thus, $\alpha$ is changed in definition as follows.

$$\alpha = \frac{r_x}{r_y} = \frac{r''_x}{r''_y} \tag{4}$$

Further, $r_x''$, $R_x$, $r_y''$ and Ry are equal in resistivity, and thus satisfy the followings:

$$r''_x = R_x \times 6\pi D_x \tag{5}$$

$$r''_y = R_y \times \frac{\pi \cdot 25^2 \cdot 10^{-6}}{D_x} \tag{6}$$

When a sectional area of current passage during measurement in (5) was acquired, a circumference having an outer diameter of 60 mm was used which is between an outer diameter 50 mm of the electrode 143 and an inner diameter 70 mm of the electrode 142.

Thus, $R_x$ and $R_y$ acquired by the resistance measurement method are substituted into the equations (5) and (6), and $\alpha$ is acquired by the equation (4).

When the resistance of the image bearing belt 3 is isotropic, the condition of $\alpha>1.22$ is replaced with the thickness definition of the image bearing belt 3. When the resistance of the image bearing belt 3 is isotropic, $\alpha$ is represented as follows:

$$\alpha = \frac{D_x^2}{D_y^2} \tag{7}$$

In the case of the present exemplary embodiment, since the resolution in the axial direction X is 300 dpi, $D_x$=84 μm. Accordingly, $\alpha>1.22$ is replaced with $D_y$=76.55 μm.

As described below, in the case of the image bearing belt 3 employed in the present exemplary embodiment, the condition of $\alpha>1.22$ is satisfied. In the case of the image bearing belts 3 of the comparative examples 1 and 2 where thin-line image formation may not be carried out, the condition of $\alpha>1.22$ is not satisfied.

In the case of the image bearing belt 3 employed in the present exemplary embodiment, the resistance $R_x$ in the axial direction X is $3.62\times10^{10}\Omega$, and the resistance $R_y$ in the thickness direction Y is $9.25\times10^{5}\Omega$. When these resistances are substituted into the equations (5) and (6), $\alpha=2.69$ is obtained. Thus, the condition of $\alpha>1.22$ is satisfied, and even image information where image formation is difficult in the image forming process of [1, 3] is within the range where an image may be formed. This result matches the fact that a thin-line image may be made by using the image bearing belt 3.

Then, $\alpha$ is calculated with respect to the image bearing belt 3 according to the comparison example 1. In the image bearing belt 3 according to the comparison example 1, the resistance $R_x$ in the axial direction X is $2.21\times10^{10}\Omega$, and the resistance $R_y$ in the thickness direction Y is $1.58\times10^{6}\Omega$. When these resistances are substituted into the equations (5) and (6, $\alpha=0.96$ is obtained. Thus, the condition of $\alpha>1.22$ is not satisfied, and image information where image formation is difficult in the image forming process of [1, 3] is not within the range of image formation. This result matches the fact that a thin-line image may not be formed by using the image bearing belt 3.

Then, $\alpha$ is calculated with respect to the image bearing belt 3 according to the comparison example 2. In the image bearing belt 3 according to the comparison example 2, the resistance $R_x$ in the axial direction X is $4.09\times10^{8}\Omega$, and the resistance $R_y$ in the thickness direction Y is $1.19\times10^{5}\Omega$. When these resistances are substituted into the equations (5) and (6), $\alpha=0.24$ is obtained. Thus, the condition of $\alpha>1.22$ is not satisfied, and image information where image formation is difficult in the image forming process of [1, 3] is not within the range of image formation. This result matches the fact that a thin-line image may not be formed by using the image bearing belt 3.

In the present exemplary embodiment, the single-layer image bearing belt 3 is employed. However, an image bearing belt of plural layers may similarly be employed.

In the case of the image bearing belt 3 employed in the present exemplary embodiment, the resistance $R_y$ in the thickness direction Y is $9.25\times10^{5}\Omega$. However, this value is in no way limitative. However, depending on conditions such as a time constant, an upper limit value may be acquired as a guide for the resistance $R_y$ of the image bearing belt 3.

When a rotational speed of the image bearing belt 3 is 130 mm/s and the resolution of the image bearing belt 3 in the rotational direction B is 300 dpi, time for moving the image bearing belt 3 by one pixel in the rotation is $6.51\times10^{-4}$ seconds. When this time is compared with the time constant of the image bearing belt 3, $7.50\times10^{5}\Omega$ is acquired as a guide for an upper limit. In this case, a specific dielectric constant is 3. This is a value near the resistance of $9.25\times10^{5}\Omega$ in the thickness direction Y of the image bearing belt 3 used in the present exemplary embodiment.

Thus, in the image forming apparatus according to the present exemplary embodiment, $\alpha$ of the image bearing belt 3 is set to $\alpha=2.69$ that satisfies $\alpha>1.22$, and thus a thin-line image having a stable line width may be formed.

While the disclosure has been described with reference to exemplary embodiments, it is to be understood that the disclosure is not limited to the disclosed exemplary embodiments. The scope of the following claims is to be accorded the broadest interpretation so as to encompass all modifications, equivalent structures, and functions.

This application claims priority from Japanese Patent Application No. 2011-275018 filed Dec. 15, 2011, which is hereby incorporated by reference herein in its entirety.

What is claimed is:

1. An image forming apparatus comprising:

an image bearing member configured to bear a toner image;

a plurality of electrode portions;

a control unit configured to control a voltage applied to the electrode portion based on image information; and a toner bearing member configured to bear toner and form a toner image on the image bearing member according to the voltage applied to the electrode portion, wherein $\alpha>1.22$ is satisfied: Dy indicating a thickness of the image bearing member, Dx indicating a distance between the electrode portions adjacent to each other, rx" indicating a resistance component of the image bearing member in a direction parallel to Dx and ry" indicating a resistance component of the image bearing member in a direction parallel to Dy in a rectangular solid body including Dx and Dy in a side, and rx"/ry" being defined as $\alpha$.

2. The image forming apparatus according to claim 1, wherein the $\alpha$ is calculated by measuring resistance Rx where the electrode portions are arranged adjacently to each other and resistance Ry in a thickness direction of the image bearing member by resistivity test of JISK 6911, and substituting the resistances into the following equations:

$$rx'' = Rx\times 6\pi D_x \text{ and} \tag{1}$$

$$r_y'' = R_y\times\frac{\pi\cdot 25^2\cdot 10^{-6}}{D_x}.$$

3. The image forming apparatus according to claim 1, wherein the image bearing member includes a plurality of different layers.

* * * * *